US009491556B2

(12) United States Patent
Fitz et al.

(10) Patent No.: US 9,491,556 B2
(45) Date of Patent: Nov. 8, 2016

(54) METHOD AND APPARATUS FOR PROGRAMMING HEARING ASSISTANCE DEVICE USING PERCEPTUAL MODEL

(71) Applicant: Starkey Laboratories, Inc., Eden Prairie, MN (US)

(72) Inventors: Kelly Fitz, Eden Prairie, MN (US); Brent Edwards, San Francisco, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 72 days.

(21) Appl. No.: 13/951,187

(22) Filed: Jul. 25, 2013

(65) Prior Publication Data

US 2015/0030170 A1 Jan. 29, 2015

(51) Int. Cl.
*H04R 29/00* (2006.01)
*H04R 25/00* (2006.01)

(52) U.S. Cl.
CPC ..... *H04R 25/70* (2013.01); *H04R 25/552* (2013.01); *H04R 29/008* (2013.01); *H04R 2225/41* (2013.01); *H04R 2225/55* (2013.01); *H04R 2460/07* (2013.01)

(58) Field of Classification Search
CPC ..... H04R 25/552; H04R 29/008; H04R 2225/41; H04R 2225/55; H04R 2460/07
USPC ..... 381/60, 312–321, 86, 92, 98, 72, 74, 381/73.1; 600/25
See application file for complete search history.

(56) References Cited

U.S. PATENT DOCUMENTS

| | | | | |
|---|---|---|---|---|
| 7,349,549 | B2 * | 3/2008 | Bachler | H04R 25/305 381/314 |
| 8,135,138 | B2 | 3/2012 | Wessel et al. | |
| 2009/0060214 | A1 * | 3/2009 | Wessel | H04R 25/70 381/60 |
| 2010/0202636 | A1 | 8/2010 | Fröhlich et al. | |
| 2012/0134521 | A1 | 5/2012 | Wessel et al. | |

OTHER PUBLICATIONS

Beebe, Nelson HF, "25 Years of TEX and METAFONT: Looking Back and Looking Forward", TUG Keynote address, (2003), 7-30.
Borg, Ingwer, et al., "Part I—Fundamentals of MDS", Modern Multidimensional Scaling: Theory and Applications Second Edition. Springer, New York, NY, (2005), 3-133.
Lallemand, I, et al., "Interaction-Optimized Sound Database Repersentation", Proc. of the 14th International Conference on Digital Audio Effects, Paris, France, (Sep. 2011), 292-299.
"European Application Serial No. 14178437.1, Extended European Search Report mailed Feb. 10, 2015", 6 pgs.

* cited by examiner

*Primary Examiner* — Sunita Joshi
(74) *Attorney, Agent, or Firm* — Schwegman Lundberg & Woessner, P.A.

(57) ABSTRACT

A hearing assistance system for delivering sounds to a listener provides for subjective, listener-driven programming of a hearing assistance device, such as a hearing aid, using a perceptual model. The system produces a distribution of presets using a perceptual model selected for the listener and allows the listener to navigate through the distribution to adjust parameters of a signal processing algorithm for processing the sounds. The use of the perceptual model increases the potential of fine tuning of the hearing assistance device available to the listener.

38 Claims, 7 Drawing Sheets

METHOD AND APPARATUS FOR PROGRAMMING HEARING ASSISTANCE DEVICE USING PERCEPTUAL MODEL

FIELD OF THE INVENTION

The present subject matter relates generally to hearing assistance systems, and in particular to method and apparatus for programming a hearing assistance devices using initial settings determined based on a perceptual model to increase tuning potential available to the listener.

BACKGROUND

A hearing assistance device, such as a hearing aid, may include a signal processor in communication with a microphone and receiver. Sound signals detected by the microphone and/or otherwise communicated to the hearing assistance device are processed by the signal processor to be heard by a listener. Modern hearing assistance devices includes programmable devices that have settings made based on the hearing and needs of each individual listener such as a hearing aid wearer.

Wearers of hearing aids undergo a process called "fitting" to adjust the hearing aid to their particular hearing and use. In such fitting sessions a wearer may select one setting over another. Other types of selections include changes in level, which can be a preferred level. Hearing aid settings may be optimized for a wearer through a process of patient interview and device adjustment. Multiple iterations of such interview and adjustment may be needed before sound quality as perceived by the wearer becomes satisfactory. This may require multiple visits to an audiologist's office. Thus, there is a need for a more efficiency process for fitting the hearing aid for the wearer.

SUMMARY

A hearing assistance system for delivering sounds to a listener provides for subjective, listener-driven programming of a hearing assistance device, such as a hearing aid, using a perceptual model. The system produces a distribution of presets using a perceptual model selected for the listener and allows the listener to navigate through the distribution to adjust parameters of a signal processing algorithm for processing the sounds. The use of the perceptual model increases the potential of fine tuning of the hearing assistance device available to the listener.

In one embodiment, a hearing assistance system includes a controller configured to produce a distribution of a plurality of presets in an N-dimensional space using the perceptual model. The plurality of presets includes predetermined settings for a plurality of parameters of a signal processing algorithm. The perceptual model provides for a prediction of one or more qualities or features of the sound processed by the signal processing algorithm as perceived by the listener for each individual preset of the plurality of presets.

In one embodiment, a method for fitting a hearing assistance device that delivers processed sound to a listener is provided. A distribution of a plurality of presets in an N-dimensional space is produced using a perceptual model. The plurality of presets includes predetermined settings for a plurality of parameters of a signal processing algorithm. The perceptual model provides for a prediction of one or more qualities or features of the processed sound perceived by the listener for each individual preset of the plurality of presets. N-dimensional coordinates representative of a position in the N-dimensional space selected by the listener are received using a user interface. The N-dimensional coordinates are mapped into selected values of the plurality of parameters. An input sound signal is processed to produce an output sound signal to be delivered to the listener by executing the signal processing algorithm using the selected values of the plurality of parameters.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
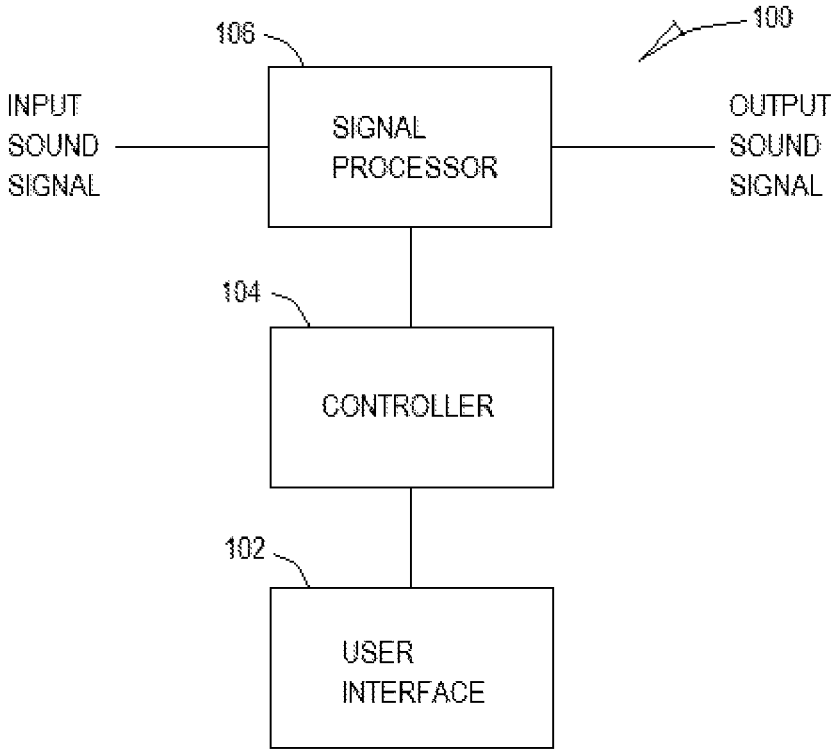
FIG. 1 is a block diagram illustrating an embodiment of a signal processing system for use in a hearing assistance system.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a subjective, listener-driven system for programming hearing assistance devices, such as hearing aids. In one example of such a system, a listener controls a system interface to organize according to perceived sound quality a number of presets (predetermined parameter settings) based on parameter settings spanning parameter ranges of interest. By such organization, the system can generate a mapping of spatial coordinates of an N-dimensional space to a plurality of parameters using interpolation of the presets organized by the listener. The system interface may use a graphical representation of the N-dimensional space. For example, a two-dimensional plane is provided to the listener in a graphical user interface to "click and drag" a preset as sound is played after being processed using the parameters corresponding to the selected preset in order to organize the presets by perceived sound quality. Presets that are perceived to be similar in quality could be organized to be spatially close together while those that are perceived to be dissimilar are organized to be spatially far apart. The resulting organization of the presets is used by an interpolation mechanism to associate the two-dimensional space with a subspace of parameters associated with the presets. The listener can then move a pointer, such as by using a computer mouse or by using a finger on a touchscreen, around the space and alter the parameters in a continuous manner. If the space and associated parameters are connected to a hearing assistance device that has parameters corresponding to the ones defined by the subspace, then the parameters in the hearing assistance device are also adjusted as the listener moves the pointer around the space. If the hearing assistance device is active, then the listener hears the effect of the parameter change caused by the moving pointer. In this way, the listener can move the pointer around the space in an orderly and intuitive way until he/she determines one or more points or regions in the space where he/she prefers the sound processing as indicated by the sound heard. In one example, a radial basis function network is used as a regression method to interpolate a subspace of parameters. The listener navigates this subspace in real time using an N-dimensional graphical interface and is able to quickly converge on his or her personally preferred sound which translates to a personally preferred set of parameters. One of the advantages of this listener-driven approach is to provide the listener with a relatively simple control for several parameters.

An example of such a system is discussed in U.S. Pat. No. 8,135,138 B2, "HEARING AID FITTING PROCEDURE AND PROCESSING BASED ON SUBJECTIVE SPACE REPRESENTATION", which is incorporated herein by reference in its entirety. SoundPoint (Starkey Laboratories, Eden Prairie, Minn., U.S.A.) is an example of a computer-based signal processing tool implementing portions of such a system.

The process of subjective, listener-driven programming hearing assistance devices includes a layout phase followed by a navigation phase. During the layout phase, a distribution (or "layout") of the presets in the N-dimensional space is produced and ready for the navigation phase during which the listener can move the pointer (i.e., "navigate") through the N-dimensional space to provide interpolated parameters to the signal processing algorithm and select one or more preferred listening settings as sound is played after being processed using the interpolated parameters. If a single distribution of the presets is used for a listener population, it may have "dead zones" for some individual listeners. Such "dead zones" for a listener are areas in which little or no variation in the sound can be heard by that listener. Possible reasons for such "dead zones" include that the parameter variations described by that part of the space are not audible to the listener, or that available gain limitations prevent the parameter variations prescribed by the layout of the space being applied in the hearing assistance device used by the listener. The presence of the "dead zones" limits the amount of usable navigation space available to the listener using the system such as SoundPoint to adjust settings of hearing assistance devices such as hearing aids.

In the system discussed in U.S. Pat. No. 8,135,138 B2, the listener may organize the distribution of the presets during the layout phase using the system's layout mode (called the "programming mode" in U.S. Pat. No. 8,135,138 B2). The layout mode includes a process by which the listener can provide subjective organization of the presets. The resulting organization is used to construct a mapping of coordinates of the N-dimensional space to a plurality of parameters. The mapping represents a weighting or interpolation of the presets organized in the layout mode. This listener organization of the presets can substantially eliminate the "dead zones" when properly performed. Then, in the navigation phase, the listener selects one or more preferred listening settings using the system's navigation mode. Examples of various aspects of the mode and navigation mode are discussed in U.S. Pat. No. 8,135,138 B2 (which refers to the "programming mode" instead of the layout mode).

The present system allows the distribution of the presets, which describes the underlying structure of the interpolator, to be organized by the system, rather than the listener, during the layout phase to eliminate the "dead zones" in the interpolation space while eliminating the need for training the listener to perform the subjective organization. In various embodiments, the present system uses a perceptual model to automatically organize the underlying layout of the interpolator by distributing the underlying presets to eliminate perceptual dead zones. The perceptual model substantially matches each individual listener's hearing loss profile and is used to predict audible differences across the system's navigation space, and the interpolator is organized to maximize those differences for each individual listener. Such customization of the navigation space takes place "behind the scenes", without any intervention or extra time or effort necessary on the part of the listener or the audiologist. In various embodiments, the present system provides each listener with a fine tuning space that is optimized according to his/her hearing loss, such that significant differences are heard across the whole space, without the perceptual "dead zones" where no variation is audible. This is achieved by providing a distribution of the presets based on the listener's perceptual model. Then, in a manner such as discussed in U.S. Pat. No. 8,135,138 B2, the listener may start with the navigation phase with the system operation in the navigation mode, with the layout mode (referenced as the "programming mode" in U.S. Pat. No. 8,135,138 B2) being optional and used only if the listener wishes to adjust the distribution of the presets produced by the system.

FIG. 1 is a block diagram illustrating an embodiment of a signal processing system 100 for use in a hearing assistance system. System 100 includes a user interface 102, a controller 104, and a signal processor 106. In various embodiments, components of system 100 may be found in any one or more devices of the hearing assistance system.

User interface 102 displays a graphical representation of a distribution of a plurality of presets in an N-dimensional space. The plurality of presets includes predetermined settings for a plurality of parameters of a signal processing algorithm for processing sounds to be heard by the listener. In various embodiments, N is an integer greater or equal to 2. In one embodiment, user interface 102 optionally allows the listener to adjust the displayed distribution of the plurality of presets before entering the navigation phase. During the navigation phase, user interface 102 receives N-dimensional coordinates associated with a position selected and moved by the listener who navigates through the N-dimensional space to select and adjust the parameter settings for the signal processing algorithm based on the processed sounds he or she hears.

Controller 104 produces a distribution of the plurality of presets in the N-dimensional space using a perceptual model. In various embodiments, the perceptual model is representative of the listener's hearing loss profile and provides for a prediction of difference between a pair of presets of the plurality of presets perceivable by the listener. In one embodiment in which the listener is allowed to adjust the distribution of the plurality of presets in the N-dimensional space as sound is played after being processed using the parameters corresponding to a selected preset, controller 104 updates the distribution according to the listener's adjustment of the displayed graphical representation made through user interface 102. During the navigation phase, controller 104 selects values of the plurality of parameters of the signal processing algorithm using predetermined mapping between N-dimensional coordinates and values of the plurality of parameters. As the listener moves the position in the N-dimensional space, the N-dimensional coordinates change accordingly, and controller 104 updates the selected values of the plurality of parameters of the signal processing algorithm in response.

Signal processor 106 processes an input sound signal to produce an output sound signal to be delivered to the listener by executing the signal processing algorithm with the selected values of the plurality of parameters. As the listener moves the position in the N-dimensional space through user interface 102, controller 104 updates the selected values of the plurality parameters for use by signal processor 106, such that the listener hears the effect of his/her selected settings.

In various embodiments, the organization of the plurality of presets can determine the behavior system 100. The plurality of presets defines desired parameter variations relative to the state of the plurality of parameters of the signal processing algorithm at the time a programming process using system 100 is launched. In some examples, the plurality of presets is determined to "increase all gains", "decrease gain at mid frequencies and increase gain at high frequencies", or "increase compression at low frequencies". The distribution of the plurality of presets is the distribution (or "layout") of a collection of presets ready for the listener to start with the navigation phase upon the launch of the programming process. These presets are invisible to the listener during the navigation phase, but their positions define changes of the plurality of parameters of the signal processing algorithm as the listener navigates the space. A distribution that is not customized for each individual listener may produce regions in which there is little or no perceivable sound change for the individual listener. The presence of such "dead zones" limits the amount of usable navigation space available to the listener. System 100 uses the listener's perceptual model in determining the distribution of the plurality of presets to maximize the amount of usable navigation space the listener.

In various embodiments, controller 104 uses the perceptual model (e.g. a loudness model) to compute a pairwise distance measure on the plurality of presets (which describe the underlying structure of the interpolator). In various embodiments, the perceptual model may be configured or parameterized using empirical data and parameterized by the listener's audiogram, so that the perceptual consequences of variation in hearing loss are captured in the model output. In various embodiments, the perceptual model used for each listener may be configured or parameterized for the listener using information acquired from the listener or selected from stored perceptual models by matching hearing loss profiles. The perceptual model is applied to a representative set of sounds processed by signal processor 106 executing the signal processing algorithm with the values of the plurality of parameters corresponding to each preset. The output of the perceptual model is used to predict the perceivable difference between pairs of presets of the plurality of presets. In one embodiment, to maximize the variation across the navigation space, controller 104 places presets that sound very different far apart, and presets that sound similar close together, in the distribution of the plurality of presets such that large differences in the model predictions imply large inter-preset distances as seen on the graphical representation displayed using user interface 102.

In various embodiments, controller 104 executes a distribution algorithm to produce the graphical representation of the distribution of the plurality of presets for displaying on user interface 102 in a way that preserves their relative spatial distances while maximizing the (predicted) audible variation in the sound in all regions of the space. Examples of such distribution algorithms include multidimensional scaling (MDS) algorithms (I. Borg, P. J. F. Groenen. *Modern Multidimensional Scaling: Theory and Applications*. Springer, New York, N.Y. (2005)), physical models such as the boxes and springs model used in page layout software packages like TeX, or the Unispring algorithm (I Lallemand and D. Schwarz, "Interaction-Optimized Sound Database Representation", *Proc. Of the* 14$^{th}$ *International Conference on Digital Audio Effects* (*DAFx*-11), Paris, France, Sep. 19-23, 2011 pp. 292-299. TeX is discussed in articles, such as Beebe, Nelson H F (2004), "25 Years of TeX and METAFONT: Looking Back and Looking Forward" (PDF), TUGboat 25: 7-30.

In various embodiments, the circuit of each element of system 100, including its various embodiments discussed in this document, may be implemented using hardware, software, firmware or a combination of hardware, software and/or firmware. In various embodiments, each of controller 104 and signal processor 106 may be implemented using one or more circuits specifically constructed to perform one or more functions discussed in this document or one or more general-purpose circuits programmed to perform such one or more functions. Examples of such general-purpose circuit can include a microprocessor or a portion thereof, a microcontroller or portions thereof, and a programmable logic circuit or a portion thereof.

Figure 2:
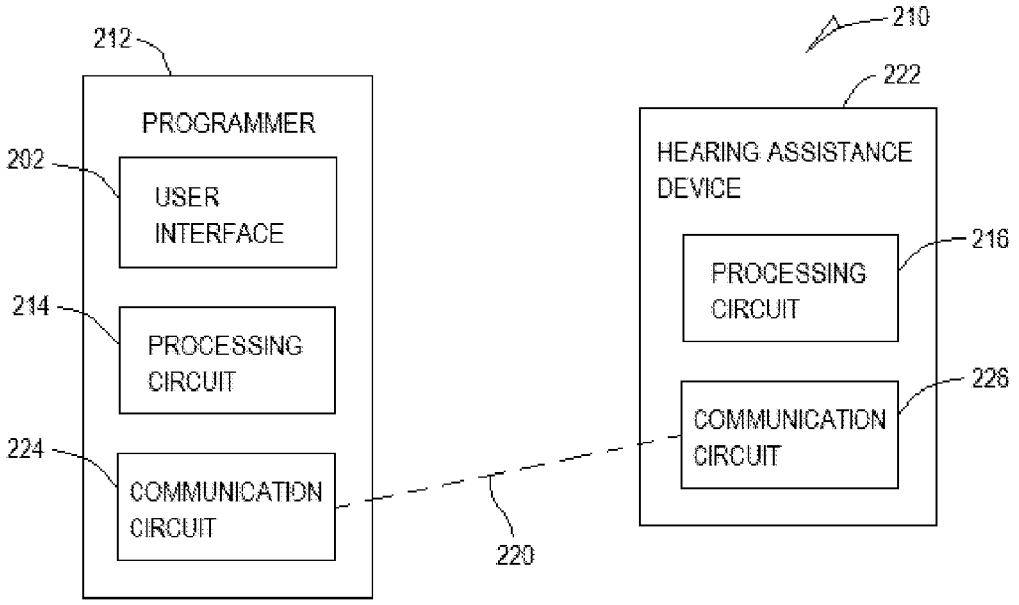
FIG. 2 is a block diagram illustrating an embodiment of the hearing assistance system.

FIG. 2 is a block diagram illustrating an embodiment of a hearing assistance system 210. In various embodiments, system 100 may be realized by system 210. In the illustrated embodiment, system 210 includes a programmer 212, a hearing assistance device 222, and a communication link 220 providing for communication between programmer 212 and hearing assistance device 222. In various embodiments, programmer 212 and hearing assistance device 222 may each include one or more devices. For example, programmer 212 may include a computer or a computer connected to a communicator, and hearing assistance device 222 may include a single device or a pair of devices such as a pair of left and right hearing aids. Communication link 220 may include a wired link or a wireless link. In one embodiment, communication link 220 includes a Bluetooth wireless connection.

Programmer 212 allows for programming of hearing assistance device 222. In various embodiments, programmer 212 may include a computer or other microprocessor-based device programmed to function as a programmer for hearing assistance device 222. Examples of such computer or other microprocessor-based device include a desktop computer, a laptop computer, a tablet computer, a handheld computer, and a cell phone such as a smartphone. Programmer 212 includes a user interface 202, a processing circuit 214, and a communication circuit 224. User interface 202 represents an embodiment of user interface 102. In various embodiments, user interface 202 includes a presentation device including at least a display screen and an input device. In various embodiments, the presentation device may also include various audial and/or visual indicators, and the user input device may include a computer mouse, a touchpad, a trackball, a joystick, a keyboard, and/or a keypad. In one embodiment, user interface 202 includes an interactive screen such as a touchscreen functioning as both the presentation device and the input device. Communication circuit 224 allows signals to be transmitted to and from hearing assistance device 222 via communication link 220.

Hearing assistance device 222 includes a processing circuit 216 and a communication circuit 226. Communication circuit 226 allows signals to be transmitted to and from programmer 212 via communication link 220.

In various embodiments, one or both of processing circuits 214 and 216 includes controller 104 and signal processor 106. In other words, controller 104 and signal processor 106 may be distributed in one or both of programmer 212 and hearing assistance device 222. In one embodiment, processing circuit 214 includes controller 104, and processing circuit 216 includes signal processor 206. In another embodiment, processing circuit 216 includes controller 104 and signal processor 106.

Figure 3:
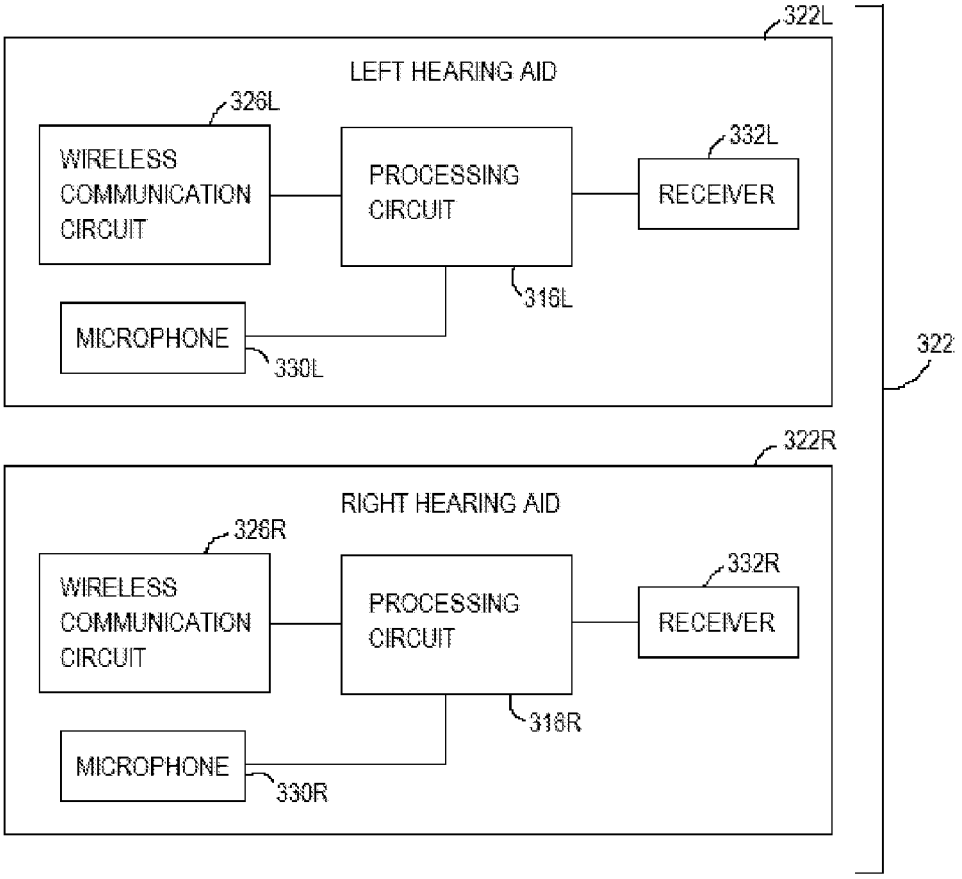
FIG. 3 is a block diagram illustrating an embodiment of a pair of hearing aids of the hearing assistance system.

FIG. 3 is a block diagram illustrating an embodiment of a pair of hearing aids 322 representing an example of hearing assistance device 222. Hearing aids 322 include a left hearing aid 322L and a right hearing aid 322R. Left hearing aid 322L includes a microphone 330L, a wireless communication circuit 326L, a processing circuit 316L, and a receiver (also known as a speaker) 332L. Microphone 330L receives sounds from the environment of the listener (hearing aid wearer). Wireless communication circuit 326L represents an embodiment of communication circuit 226 and wirelessly communicates with programmer 212 and/or right hearing aid 322R, including receiving signals from programmer 212 directly or through right hearing aid 322R. Processing circuit 316L represents an embodiment of processing circuit 216 and processes the sounds received by microphone 330L and/or an audio signal received by wireless communication circuit 326L to produce a left output sound. Receiver 332L transmits the left output sound to the left ear canal of the listener.

Right hearing aid 322R includes a microphone 330R, a wireless communication circuit 326R, a processing circuit 316R, and a receiver (also known as a speaker) 332R. Microphone 330R receives sounds from the environment of the listener. Wireless communication circuit 326R represents an embodiment of communication circuit 226 and wirelessly communicates with programmer 212 and/or left hearing aid 322L, including receiving signals from programmer 212 directly or through left hearing aid 322L. Processing circuit 316R represents an embodiment of processing circuit 216 and processes the sounds received by microphone 330R and/or an audio signal received by wireless communication circuit 326R to produce a right output sound. Receiver 332R transmits the right output sound to the right ear canal of the listener.

In various embodiments, one or both of processing circuits 316L and 316R include portions of controller 104 and/or signal processor 106. In one embodiment, one or both of processing circuits 316L and 316R include signal processor 106. In another embodiment, one or both of processing circuits 316L and 316R include controller 104 and signal processor 106.

Figure 4A:
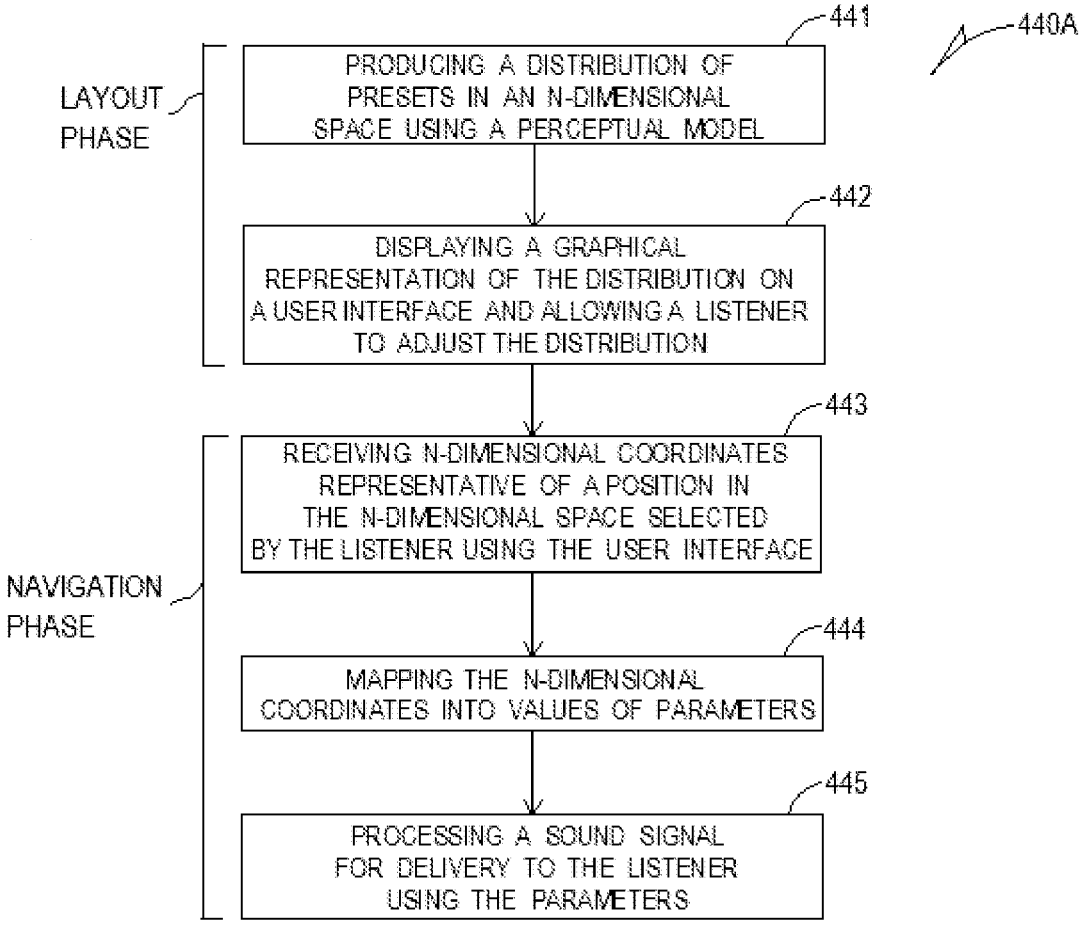
FIG. 4A is a flow chart illustrating an embodiment of a method for hearing assistance device programming.
Figure 4B:
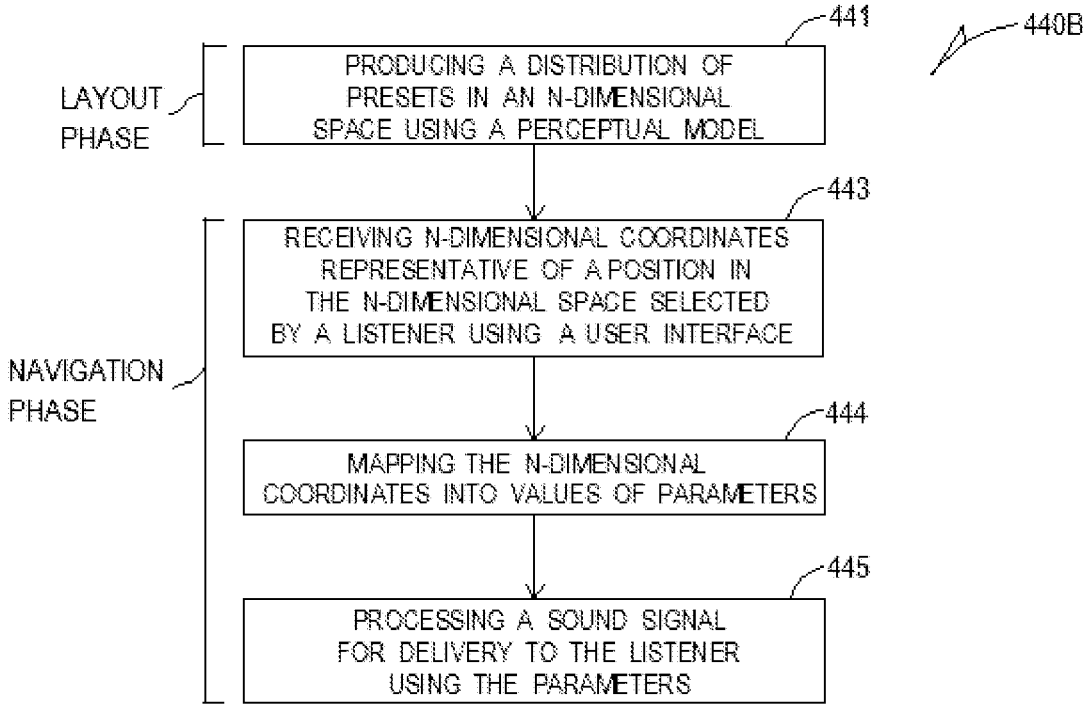
FIG. 4B is a flow chart illustrating another embodiment of a method for hearing assistance device programming.

FIG. 4A is a flow chart illustrating an embodiment of a method 440A for programming hearing assistance device for a listener. When the programming is performed through the layout and navigation phases as discussed above, steps 441 and 442 are performed during the layout phase, and steps 443 and 444 are performed during the layout phase. Step 445 may be performed during any phase of programming and use of the hearing assistance device. In the illustrated embodiment, step 445 is performed during both the layout phase (e.g., as the listener adjusts the distribution of the plurality of presets) and the navigation phase. FIG. 4B is a flow chart illustrating an embodiment of a method 440B for programming hearing assistance device for a listener. When the programming is performed through the layout and navigation phases as discussed above, step 441 is performed during the layout phase, and steps 443 and 444 are performed during the layout phase. Step 445 may be performed during any phase of programming and use of the hearing assistance device.

Method 440B differs from method 440A in that step 442 is omitted. In various embodiments, methods 440A and 440B are each performed using system 100, including various embodiments of its elements as discussed in this document. For example, controller 104 may be programmed to perform steps 441, 442 (optionally), 443, and 444, and signal processor 106 may be programmed to perform step 445. In one embodiment, methods 440A and 440B are each applied to program a hearing aid or a pair of left and right hearing aid for the listener being a hearing aid wearer.

At 441, a distribution of a plurality of presets in an N-dimensional space is produced using a perceptual model. In various embodiments, N is an integer greater or equal to 2. In one embodiment, the N-dimensional space is a two-dimensional space (i.e., N=2). In another embodiment, the N-dimensional space is a three-dimensional space (i.e., N=3). The plurality of presets includes predetermined settings for a plurality of parameters of a signal processing algorithm. The perceptual model provides a prediction of one or more qualities or features of processed sound perceived by the listener for each individual preset of the plurality of presets. In various embodiments, the perceptual model is configured or parameterized using data substantially representative of the listener's hearing loss profile. In various embodiments, the perceptual model is configured or parameterized using empirical data and/or an audiogram that is recorded for the listener or representative of the listener's hearing loss profile. In various embodiments, the perceptual model is configured or parameterized and stored in a database for various hearing loss profiles and/or hearing assistance device types, and selected for each listener by matching his/her hearing loss profile and/or type of hearing assistance device used.

At 442, a graphical representation of the distribution of the plurality of presets on the N-dimensional space is displayed on a user interface to the listener, who can start with the navigation phase. This is optionally performed only in method 440A as illustrated in FIG. 4A, in which the listener is allowed to adjust the distribution at this point. However, when step 441 is properly performed by the system with a perceptual model adequately determined for the individual listener, the need for such adjustment should be eliminated, or at least minimized, such that method 440B may be performed for the listener (with step 442 omitted as illustrated in FIG. 4B). In various embodiments, method 440A is to be performed when the listener is likely able to substantially improve the distribution of the plurality of presets by his or her adjustment.

At 443, N-dimensional coordinates representative of a position in the N-dimensional space selected by the listener using the user interface. In one embodiment, the graphical representation of the distribution of the plurality of presets is displayed on a touchscreen of the user interface, and the N-dimensional coordinates representative of the position selected by the listener are received using the touchscreen. The position may be moved in the N-dimensional space by the user using the user interface. In various embodiments, the position is visually represented as a pointer on the user interface that is movable by the listener, such as by using a computer mouse or a finger (on a touchscreen).

At 444, the N-dimensional coordinates are mapped to values of the plurality of parameters of the signal processing algorithm, thereby selecting the values of the plurality of parameters, based on predetermined mapping between the N-dimensional coordinates and values the plurality of parameters. In one embodiment, the N-dimensional coordinates are mapped into the selected values of the plurality of parameters using the hearing assistance device. In another embodiment, the N-dimensional coordinates are mapped into the selected values of the plurality of parameters using a programmer communicatively coupled to the hearing assistance device. In various embodiments, the N-dimensional coordinates are updated as the listener moves the position in the N-dimensional space, and the selection of the values of the plurality of parameters of the signal processing algorithm is updated in response.

At 445, an input sound signal is processed to produce an output sound signal to be delivered to the listener by executing the signal processing algorithm with the selected values of the plurality of parameters mapped from the N-dimensional coordinates and updated as the N-dimensional coordinates change. The signal processing algorithm is executed within and using the hearing assistance device, such as the hearing aid or the pair of left and right hearing aids. During the navigation phase, as the listener moves the position in the N-dimensional space, the updated N-dimensional coordinates are mapped to the selected values of the plurality of parameters, and the effect is reflected in the output sound signal.

Figure 5:
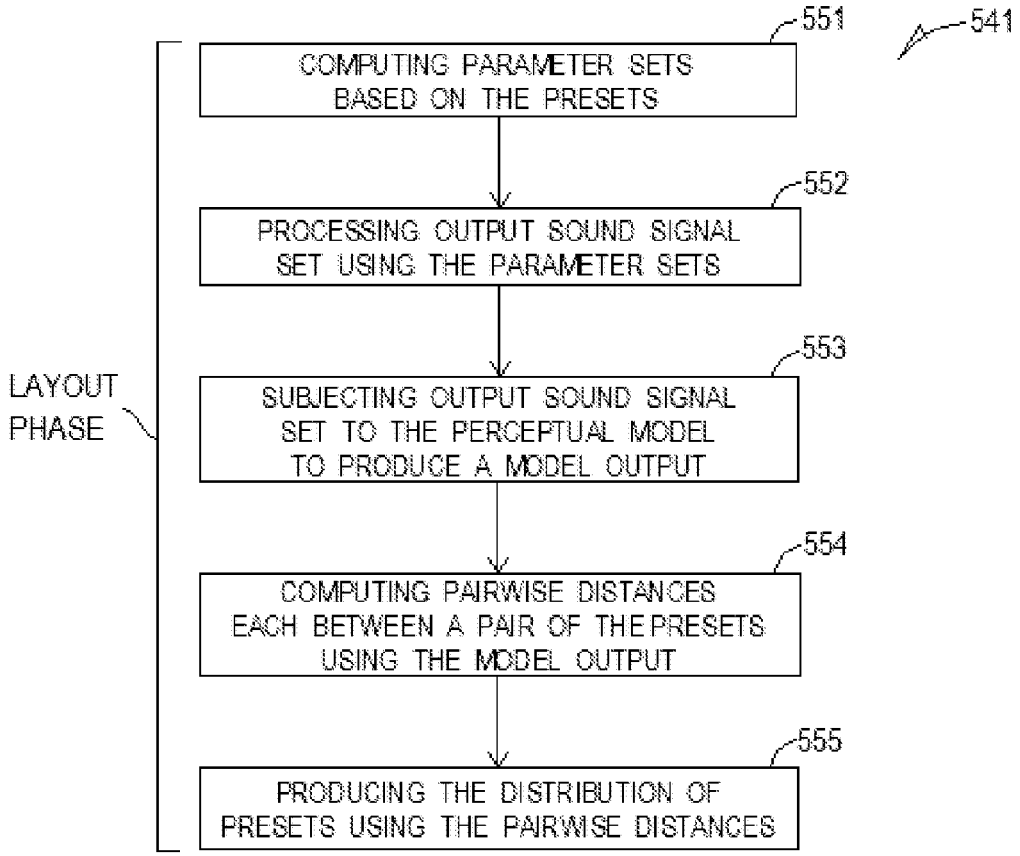
FIG. 5 is a flow chart illustrating an embodiment a process for initializing parameter settings in the method of FIG. 4.

FIG. 5 is a flow chart illustrating an embodiment a process 541 for producing the distribution of the plurality of presets in the N-dimensional space in method 440. Process 541 represents an embodiment of step 441. In one embodiment, controller 104 is programmed to perform process 541.

At 551, parameter sets (sets of values of the plurality of parameters of the signal processing algorithm) each corresponding to a preset of the plurality of presets are computed. At 552, a set of the output sound signals are processed using the computed parameter sets. At 553, the set of the output sound signals are subjected to the perceptual model to produce a model output representing the prediction of the one or more qualities or features of each processed signal of the set of output sound signals perceived by the listener (for each individual preset of the plurality of presets). In various embodiments, the model output includes a numeric representation of the predicted qualities or features of the processed sound (such as loudness, roughness, and brightness) as perceived by the listener. In various embodiments, the prediction indicates difference between each pair of presets of the plurality of presets perceivable by the listener. At 554, pairwise distances each between a pair of presets of the plurality of presets are computed using the model output. At 555, the distribution of the plurality of presets in the N-dimensional space is produced using the computed pairwise distances. In various embodiments, a distribution algorithm such as the MDS, TeX, or Unispring algorithm is used to distribute the presets behind the user interface to maximize the fine tuning potential available to the listener.

Figure 6:
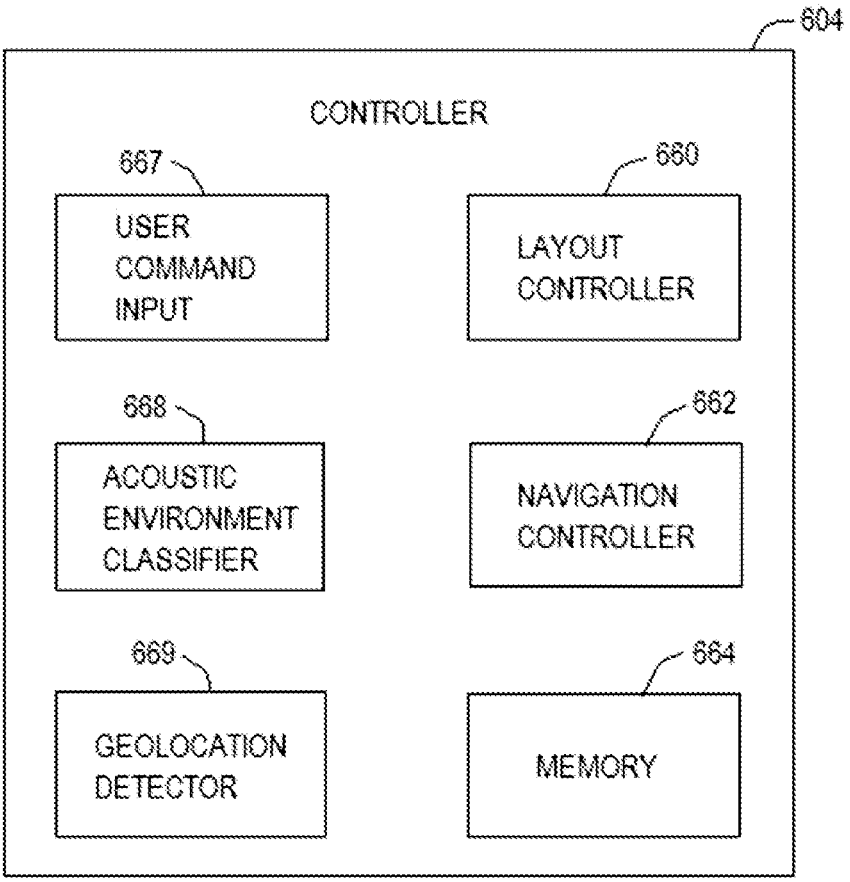
FIG. 6 is a block diagram illustrating an embodiment of a controller of the signal processing system.

FIG. 6 is a block diagram illustrating an embodiment of a controller 604, which represents an embodiment of controller 104. Controller 604 includes a layout controller 660, a navigation controller 662, a memory 664, a user command input 776, an environment classifier 668, and a geolocation detector 669. In various embodiments, controller 604 is configured to perform the various functions of controller 104 as discussed above. In various embodiments, in addition to receiving input from the listener through user interface 102, controller 604 allows for selection and adjustment of values for the plurality of parameters of the signal processing algorithm using the acoustic environment and/or the geolocation of the listener.

In various embodiments, the perceptual model as discussed above may or may not be used in producing the distribution of the plurality of presets in the N-dimensional space during the layout phase. In various embodiments, layout controller 660 is configured to produce the distribution of the plurality of presets in the N-dimensional space during the layout phase, and map the coordinates in the N-dimensional space (the N-dimensional coordinates) to the sets of values of the plurality of parameters of the signal processing algorithm. In one embodiment, layout controller 660 is configured to produce the distribution of the plurality of presets in the N-dimensional space using the perceptual model during the layout phase (e.g., configured to perform step 441 of method 440A or 440B, or method 541). In another embodiment, layout controller 660 is configured to produce the distribution of the plurality of presets in the N-dimensional space without using the perceptual model (such as allowing the listener to organize the distribution). Navigation controller 662 is configured to allow adjustment of the selected values of the plurality of parameters during the navigation phase (e.g., configured to perform steps 442, 443, and 444 of method 410). Memory 664 is configured for storage of various data needed for the operation of controller 604, including, for example, the signal processing algorithm, the plurality of presets, sets of values of the plurality of parameters of the signal processing algorithm, and the mapping between the N-dimensional coordinates and the sets of values of the plurality of parameters.

In various embodiment, the signal processing algorithm includes a tinnitus noise masking algorithm, a noise reduction algorithm, a frequency lowering algorithm, a music processing algorithm, a speech enhancement algorithm, a transient suppression algorithm, an artificial bass enhancement algorithm, a feedback suppression algorithm, an artificial reverberation algorithm, a dereverberation algorithm, or a combination of any two or more of these algorithms. Thus, system 100 allows for adjustment of parameters of such algorithms.

In one embodiment, as the listener moves the position in the N-dimensional space during the navigation phase using user interface 102, navigation controller 662 generates a representation of changes in the signal processing algorithm, and user interface 102 presents the representation of the changes. In one embodiment, the representation includes a graphical representation. For example, when the signal processing algorithm includes multi-band compression, the graphical representation includes gain curves that changes as the user moves the position in the N-dimensional space. As another example, the graphical representation displays the predicted audio output of the hearing device, or the frequency spectrum thereof. Other examples are possible without departing from the scope of the present subject matter.

In one embodiment, a mobile device such as an iPhone or iPad (Apple, Cupertino, Calif., U.S.A.) is used as programmer 212, with wireless connectivity to hearing assistance device 212. The mobile device provides for user interface 202, and hearing assistance device 212 includes, as portions of processing circuit 216, at least layout controller 660, navigation controller 662, and memory 664, as well as signal processor 106. In various embodiments, the mobile device may include an acoustic environment classifier 668 and/or geolocation detector 669 as its built-in function(s).

In various embodiments, controller 604 may include any one, two, or all of user command input 667, acoustic environment classifier 668, and geolocation detector 669. User command input 667 receives commands from the listener through user interface 102. Acoustic environment classifier 668 detects the acoustic environment of system 100 and classifies the acoustic environment as one of specified acoustic environment types. Geolocation detector 669 detects the geolocation of system 100.

In one embodiment, layout controller 662 adjusts the mapping of the N-dimensional coordinates to the set of values for the plurality of parameters of the signal processing algorithm using signals from user command input 667, acoustic environment classifier 668, and/or geolocation detector 669. In one embodiment, preferred mappings between the N-dimensional coordinates to the set of values for the plurality of parameters are stored in memory 664. The preferred mappings are each associated with a particular acoustic environment, geolocation, or other scenario that the listener is expected to repeatedly encounter. In various embodiments, layout controller 660 selects a mapping from the stored preferred mappings in response to a user command received by user command input 667, an acoustic environment type identified by environment classifier 668, and/or a geolocation identified by geolocation detector 669.

In one embodiment, navigation controller 662 adjusts the selected values of the plurality of parameters for the signal processing algorithm using signals from user command input 667, acoustic environment classifier 668, and/or geolocation detector 669. In one embodiment, preferred sets of N-dimensional coordinates (representative of preferred positions in the N-dimensional space) and/or their corresponding set of values of the plurality of parameters of the signal processing algorithm are stored in memory 664. The preferred sets are each associated with a position in the N-dimensional space selected by the listener for a particular acoustic environment, geolocation, or other scenario that the listener is expected to repeatedly encounter. In various embodiments, navigation controller 662 selects a set of N-dimensional coordinates and/or their corresponding set of values of the plurality of parameters from the stored preferred sets in response to a user command received by user command input 667, an acoustic environment type identified by environment classifier 668, and/or a geolocation identified by geolocation detector 669.

Thus, settings for hearing assistance device 212 may be selected and adjusted based on the needs and/or circumstances identified by the listener, the type of acoustic environment that the listener is in, and/or the geolocation of the listener. In one example, one or more predetermined acoustic environment types are stored in memory 664. When the listener is in a particular acoustic environment, acoustic environment classifier 668 detects characteristics of the acoustic environment and match with the stored one or more predetermined acoustic environment types to identify the acoustic environment type. Layout controller 660 selects a mapping from the stored preferred mappings between the N-dimensional coordinates and the set of values for the plurality of parameters of the signal processing algorithm for the identified acoustic environment type. In another example, one or more predetermined geolocations are stored in memory 664. The listener may identify the geolocation where he or she is by selecting from the stored one or more predetermined geolocations using user interface 102. Navigation controller 662 selects a set of N-dimensional coordinates and/or their corresponding set of values of the plurality of parameters from the stored preferred sets predetermined for the identified geolocation (i.e., the selected stored geolocation). In another example, the listener's geolocation is automatically identified by geolocation detector 669, such as when a mobile device having a built-in geolocationing function is used as programmer 212. Navigation controller 662 selects a set of N-dimensional coordinates and/or their corresponding set of values of the plurality of parameters from the stored preferred sets predetermined for the geolocation. Navigation controller 662 selects a set of N-dimensional coordinates and/or their corresponding selected values of the plurality of parameters from the stored preferred sets predetermined for the identified geolocation by geolocation detector 669. These examples are discussed to illustrate, and not to restrict, possible applications of system 100 with controller 604 in hearing assistance device fitting.

The present subject matter is demonstrated in the fitting of hearing aids, including but not limited to, behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. The present subject matter can also be used in hearing assistance devices generally, such as cochlear implant type hearing assistance devices. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance system for delivering processed sound to a listener, comprising:

a controller configured to produce a distribution of a plurality of presets in an N-dimensional space automatically using a perceptual model, the plurality of presets including predetermined settings for a plurality of parameters of a signal processing algorithm, the perceptual model representative of the listener's hearing loss profile and providing for a prediction of difference between each pair of presets of the plurality of presets perceivable by the listener, the prediction of difference used by the controller to produce the distribution of the plurality of presets in the N-dimensional space.

2. The system of claim 1, wherein the controller is configured to:

compute parameter sets each corresponding to a preset of the plurality of presets, the parameter sets each including a set of values for the plurality of parameters;

process a set of output sound signals using the computed parameter sets;

subject the set of the output sound signals to the perceptual model to produce a model output representative of the prediction of the one or more qualities or features of each processed signal of the set of output sound signals perceived by the listener;

compute pairwise distances each between a pair of presets of the plurality of presets using the model output; and produce the distribution of the plurality of presets using the computed pairwise distances.

3. The system of claim 2, wherein the user interface is configured to display a graphical representation of the distribution of the plurality of presets in an N-dimensional space.

4. The system of claim 3, wherein the user interface is configured to receive an adjustment of the distribution of the plurality of presets from the listener.

5. The system of claim 1, wherein the user interface is configured to receive N-dimensional coordinates representative of a position in the N-dimensional space selected by the listener, and the controller is configured to select values of the plurality of parameters based on predetermined mapping between the N-dimensional coordinates and the values of the plurality of parameters.

6. The system of claim 5, wherein the controller is configured to update the selected values of the plurality of parameters in response to the position in the N-dimensional space being moved by the listener using the user interface.

7. The system of claim 6, further comprising a signal processor configured to process an input sound signal and produce an output sound signal to be delivered to the listener by executing the signal processing algorithm using the selected values of the plurality of parameters.

8. The system of claim 7, comprising a hearing aid including the signal processor.

9. The system of claim 8, wherein the hearing aid further includes the controller.

10. The system of claim 8, comprising a programmer configured to be communicatively coupled to the hearing aid, the programmer including the user interface and the controller.

11. The system of claim 10, wherein the programmer comprises a cell phone.

12. The system of claim 10, wherein the programmer comprises a computer.

13. The system of claim 12, wherein the computer is a tablet computer.

14. The system of claim 10, wherein the user interface comprises a touchscreen configured to receive the N-dimensional coordinates representative of the position in the N-dimensional space selected by the listener.

15. The system of claim 5, comprising a storage device storing the signal processing algorithm including one or more of a tinnitus noise masking algorithm, a noise reduction algorithm, a frequency lowering algorithm, a music processing algorithm, a speech enhancement algorithm, a transient suppression algorithm, an artificial bass enhancement algorithm, a feedback suppression algorithm, an artificial reverberation algorithm, or a dereverberation algorithm.

16. The system of claim 5, wherein the controller is configured to generate a representation of changes in the signal processing algorithm in response to the position in the N-dimensional space being moved by the listener using the user interface, and the user interface is configured to present the representation of changes in the signal processing algorithm.

17. The system of claim 5, further comprising an acoustic environment classifier configured to detect an acoustic environment and classify the acoustic environment as a specified acoustic environment type, and the controller is configured to adjust the signal processing algorithm using the specified acoustic environment type.

18. The system of claim 17, wherein the controller is configured to select the predetermined mapping between the N-dimensional coordinates and the values of the plurality of parameters using the specified acoustic environment type.

19. The system of claim 17, wherein the controller is configured to select a set of the N-dimensional coordinates or the values of the plurality of parameters corresponding to the set of the N-dimensional coordinates using the specified acoustic environment type.

20. The system of claim 5, further comprising a geolocation detector configured to detect a geolocation, and the controller is configured to adjust the signal processing algorithm using the geolocation.

21. The system of claim 20, wherein the controller is configured to select the predetermined mapping between the N-dimensional coordinates and the values of the plurality of parameters using the geolocation.

22. The system of claim 5, wherein the controller is configured to select a set of the N-dimensional coordinates or the values of the plurality of parameters corresponding to the set of the N-dimensional coordinates using the geolocation.

23. A method for fitting a hearing assistance device that delivers processed sound to a listener, comprising:

producing a distribution of a plurality of presets in an N-dimensional space automatically using a perceptual model, the plurality of presets including predetermined settings for a plurality of parameters of a signal processing algorithm, the perceptual model representative of the listener's hearing loss profile and providing for a prediction of difference between each pair of presets of the plurality of presets perceivable by the listener, the prediction of difference used in the production of the distribution of the plurality of presets in the N-dimensional space;

receiving N-dimensional coordinates representative of a position in the N-dimensional space selected by the listener using a user interface;

mapping the N-dimensional coordinates into selected values of the plurality of parameters; and processing an input sound signal to produce an output sound signal to be delivered to the listener by executing the signal processing algorithm using the selected values of the plurality of parameters.

24. The method of claim 23, further comprising configuring the perceptual model for the listener using the listener's hearing loss profile.

25. The method of claim 24, wherein configuring the perceptual model for the listener using the listener's hearing loss profile comprises matching the listener's hearing loss profile to a hearing loss profile represented by a stored perceptual model.

26. The method of claim 24, wherein configuring the perceptual model for the listener using the listener's hearing loss profile comprises configuring the perceptual model using the listener's audiogram.

27. The method of claim 24, wherein configuring the perceptual model for the listener using the listener's hearing loss profile comprises configuring the perceptual model using the empirical data.

28. The method of claim 23, wherein producing the distribution of the plurality of presets on the N-dimensional space comprises:

computing parameter sets each corresponding to a preset of the plurality of presets, the parameter sets each including a set of values for the plurality of parameters;

processing a set of the output sound signals using the computed parameter sets;

subjecting the set of the output sound signals to the perceptual model to produce a model output representing the prediction of the one or more qualities or features of each processed signal of the set of output sound signals perceived by the listener;

computing pairwise distances each between a pair of presets of the plurality of presets using the model output; and producing the distribution of the plurality of presets using the computed pairwise distances.

29. The method of claim 28, wherein N=2.

30. The method of claim 28, wherein N=3.

31. The method of claim 23, wherein executing the signal processing algorithm comprises executing the signal processing algorithm using a hearing aid.

32. The method of claim 31, wherein mapping the N-dimensional coordinates into the selected values of the plurality of parameters comprises mapping the N-dimensional coordinates into the selected values of the plurality of parameters using the hearing aid.

33. The method of claim 31, wherein mapping the N-dimensional coordinates into the values of the plurality of parameters comprises mapping the N-dimensional coordinates into the selected values of the plurality of parameters using a programmer communicatively coupled to the hearing aid.

34. The method of claim 23, comprising:

displaying a graphical representation of the distribution of the plurality of presets on the user interface; and receiving adjustment of the distribution of the plurality of presets by the listener using the user interface.

35. The method of claim 23, further comprising receiving updated N-dimensional coordinates as the listener moves the position in the N-dimensional space using the user interface, and mapping the updated N-dimensional coordinates into the selected values of the plurality of parameters.

36. The method of claim 35, further comprising generating a representation of changes in the signal processing algorithm in response to the position in the N-dimensional space being moved by the listener using the user interface, and presenting the representation of changes in the signal processing algorithm using the user interface.

37. The method of claim 23, further comprising:

detecting an acoustic environment;

classifying the acoustic environment as a specified acoustic environment type; and adjusting parameters of the signal processing algorithm using the specified acoustic environment type.

38. The method of claim 23, further comprising:

detecting a geolocation; and adjusting parameters of the signal processing algorithm using the geolocation.

* * * * *